United States Patent [19]

Lutz et al.

[11] Patent Number: 4,981,212

[45] Date of Patent: Jan. 1, 1991

[54] MEANS FOR HOLDING AND DISPENSING GOODS INTENDED FOR SALE

[75] Inventors: Frieder Lutz, Sprockhövel; Alexander Lutz, Solingen, both of Fed. Rep. of Germany

[73] Assignee: Messrs. Lutz Kommanditgesellschaft Stahlwarenfabrik, Fed. Rep. of Germany

[21] Appl. No.: 455,833

[22] Filed: Dec. 15, 1989

Related U.S. Application Data

[63] Continuation of Ser. No. 246,864, Sep. 20, 1988, abandoned.

[30] Foreign Application Priority Data

Oct. 9, 1987 [DE] Fed. Rep. of Germany ... 713589[U]

[51] Int. Cl.[5] ..... B65D 83/10; B65D 73/00; B65H 1/12

[52] U.S. Cl. ..... 206/465; 206/355; 206/469; 221/232

[58] Field of Search ..... 206/461, 464, 465, 468, 206/469–470, 471, 806, 807, 45.34, 45.31, 354, 355; 356/221, 283, 312 R, 312 A

[56] References Cited

U.S. PATENT DOCUMENTS

| | | | |
|---|---|---|---|
| 2,288,979 | 7/1942 | Testi | 206/355 X |
| 2,344,961 | 3/1944 | Benjamin | 202/355 |
| 2,410,311 | 10/1946 | Steinbach | 206/356 X |
| 2,468,612 | 4/1949 | Auerbach | 206/356 |
| 2,680,291 | 6/1954 | Shnitzler et al. | 206/355 X |
| 2,775,366 | 12/1956 | Willhelm | 221/312 R |
| 3,336,108 | 10/1967 | Wizelman . | |
| 3,549,046 | 12/1970 | Hen | 206/355 X |
| 3,550,796 | 12/1970 | Wolk | 206/461 |
| 3,896,933 | 7/1975 | Bockemuhl | 206/469 |
| 4,305,504 | 12/1981 | Bredal | 206/468 X |
| 4,311,234 | 1/1982 | Wildgoose | 206/354 |
| 4,331,237 | 5/1982 | Edell . | |
| 4,694,960 | 9/1987 | Phipps et al. | 206/469 |

FOREIGN PATENT DOCUMENTS

| | | | |
|---|---|---|---|
| 55621 | 12/1981 | European Pat. Off. . | |
| 1952531 | 10/1969 | Fed. Rep. of Germany | 206/465 |
| 1952532 | 5/1971 | Fed. Rep. of Germany | 202/461 |
| 3606974 | 11/1986 | Fed. Rep. of Germany | 206/461 |
| 8000689 | 4/1980 | PCT Int'l Appl. . | |
| 1116420 | 6/1968 | United Kingdom | 206/465 |

*Primary Examiner*—Bryon P. Gehman

*Attorney, Agent, or Firm*—Merchant, Gould, Smith, Edell, Welter & Schmidt

[57] ABSTRACT

There is disclosed a device for holding knife blades intended for sale, comprising a stiff sheet-like carrier on which there is mechanically mounted a dispenser which receives the blades and protects them from direct access, in such a way that the carrier has to be destroyed in order to open the dispenser and to free it from the carrier.

13 Claims, 6 Drawing Sheets

MEANS FOR HOLDING AND DISPENSING GOODS INTENDED FOR SALE

This is a continuation of application Ser. No. 07/246,864, filed Sept. 20, 1988 now abandoned.

BACKGROUND AND SUMMARY OF THE INVENTION

The invention relates to means for holding goods intended for sale , such as knife blades or the like, comprising a stiff sheet-like carrier preferably containing a hole for hanging it, and on which the goods are detachably secured and protected against direct access.

It is know to arrange knife blades for universal knifes for self-service sales points side-by-side or superimposed on stiff sheet-like carriers such as sheets of card, and to secure them to this carrier with the help of a transparent plastics film which is applied over the carrier for this purpose and tensioned. In such an arrangement it is, however, a drawback that to remove individual blades the holding means which also serve as the pack must be destroyed so that the blades can be removed from the holding means between the carrier and the plastics film stretched over it. Frequently the plastics film sticks in particular to the knife blades so that the removal of the blades from the holding means is troublesome. In fact the individual knife blades are also frequently not freely accessible even after destruction of the holding means or they are no longer held so at all that they can lie around unchecked.

It is also known to mount goods intended for sale, such as knife blades, in a dispenser which is secured with the aid of rivets to the upper surface of a sheet-like carrier made of cardboard. This dispenser is complicated in its construction. To remove individual knife blades one can move portions of the dispenser relative to one and another, and the dispenser does not need to removed from the sheet-like carrier for this purpose. Accordingly it is possible to remove blades from the dispenser without the device having first been purchased. Such a device causes problems for self-service operations as it allows opportunities for dishonest handling. Added to this is the fact that the method of securing the dispenser to the carrier is relatively expensive.

The object of the invention is to solve the problem of providing means for holding goods intended for sale, such as knife blades or the like, which on the one hand is low in cost and on the other hand does not permit direct access to the goods without destruction of the holding means, yet the authorised removal of the goods and their storage is arranged to be convenient and easy.

This object is achieved according to the invention by means of the kind stated in the introductory part above and having the characterising features of claim 1. Advantageous further features of the invention form the subject of the other claims.

In the means according to the invention the goods intended for sale, and in particular by self-service, are mounted in a dispenser which is of rigid form and which comprises a housing for receiving the goods and is mechanically and detachably connected to at least one portion of the carrier so that when the goods, namely in particular the knife blades are sold, the dispenser can be removed from the carrier, preferably being torn off, and the knife blades are removed individually from the dispenser as required. With this aim in mind the dispenser is preferably arranged in an opening in the carrier, portions of the carrier engaging at least at one point mechanically in the housing of the dispenser so that the dispenser is mechanically connected to the sheet-like carrier for selling and can advantageously only be removed from it by destruction of the carrier. The dispenser is simultaneously a sales pack and a use pack for the goods and is securely retained on the carrier without additional means such as skin films or blisters.

According to a further feature of the invention the dispenser itself is not only provided with a slot-shaped removal opening for the knife blades but also with a tear-off cover which must be removed before one can remove the knife blades, for example by sliding them out of the dispenser with a thumb or a finger. This is an effective protection against unauthorised removal of individual blades from the carrier while it is still secured to the holding means and not yet sold. In addition the cover protects the knife blades in the dispenser from environmental factors so that they will not corrode e.g. rust, prematurely. In known holding means with skin packs comprising a plastics film stretched over a sheet-like carrier the tendency of the knife blades packed in that way to rust is a major problem.

According to another feature of the invention the housing of the dispenser is made in two parts which not only contain the goods for sale such as the knife blades and a spring urging the blades towards the removal position, but also achieve a mechanical connection to the sheet-like carrier, so that it is possible in a simple and economical manner to mount the housing on the carrier in such a way that portions of the carrier engage in the housing and in fact webs remaining on the carrier in the region of the receiving opening can pass right through the housing.

In this way the dispenser, without having to be covered over by a protective film, can be connected to the carrier in such a way that detachment of the dispenser from the carrier is only possible by destroying the carrier, and likewise the goods can only be removed from the dispenser if the latter has been partially destroyed, namely in that the tear-off cover provided on it has been removed.

By virtue of the invention there has been provided a sales aid, particularly suitable for knife blades, and suitable in particular for self-service sales points, and which achieves a convenient possibility for removal of the goods sold, while at the same time making it impossible for the goods to be removed from the holding means without authority, i.e. without prior purchase.

DESCRIPTION OF THE DRAWINGS

Two embodiments of the holding means for knife blades intended for sale are illustrated diagrammatically by way of example in the drawing, in which.

DESCRIPTION

Figure 1:
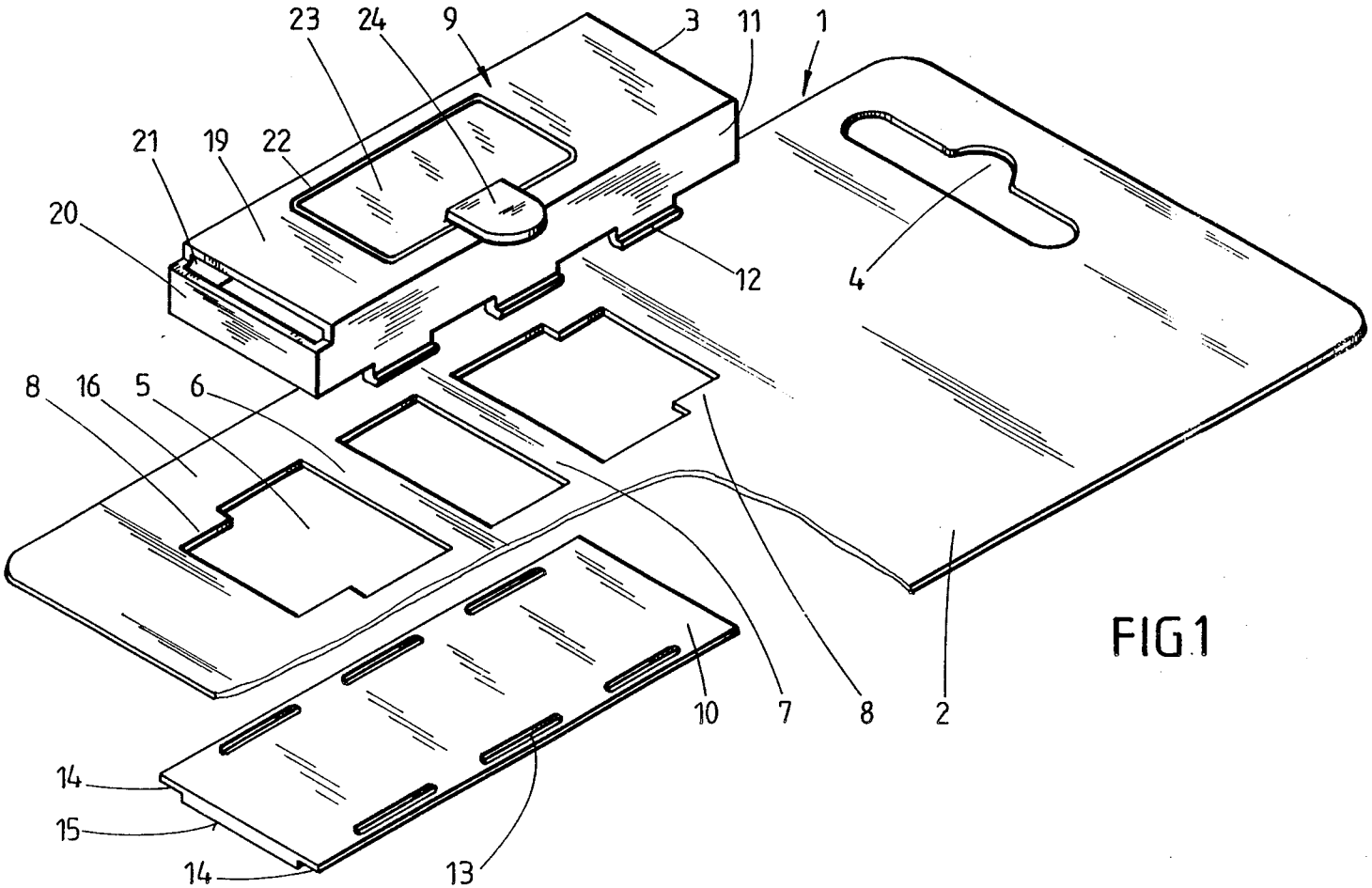
FIG. 1 is an exploded perspective view of the important parts of one embodiment of the device.
Figure 2:
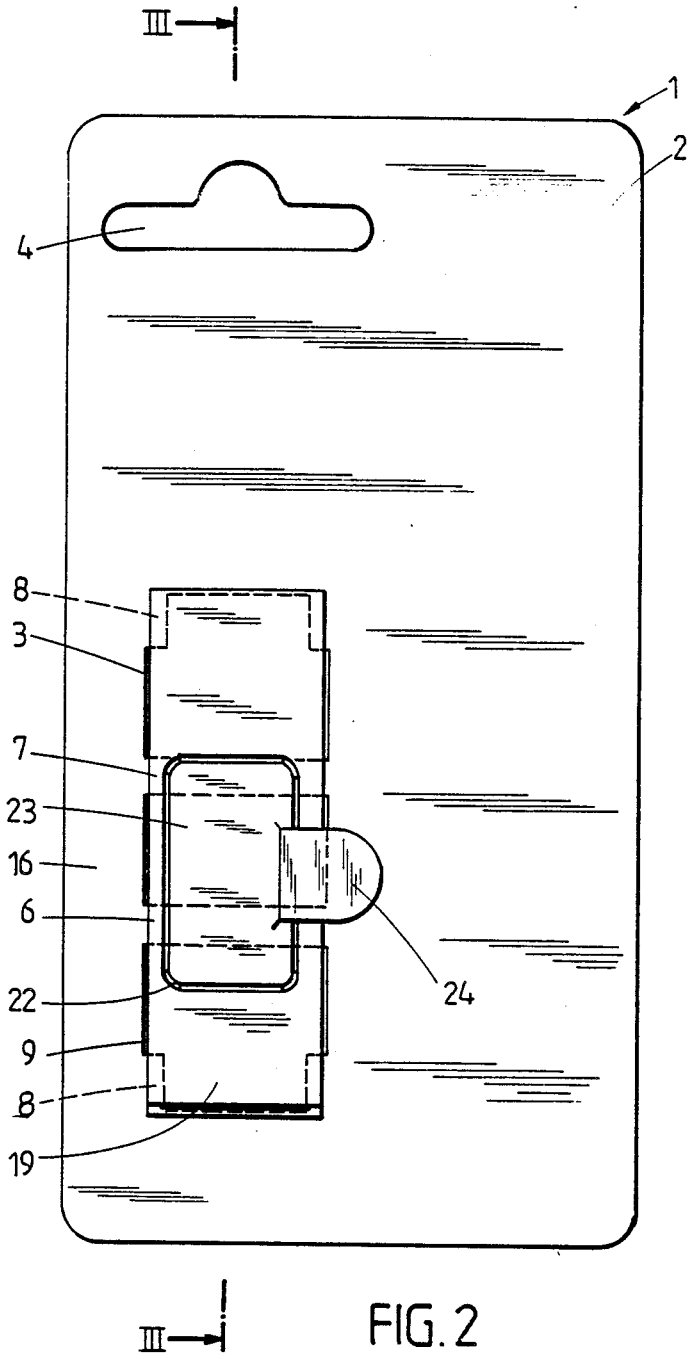
FIG. 2 is a plan view of the assembled device of FIG. 1.

The embodiment of the device shown in FIGS. 1 to 5 is illustrated in the drawings to a enlarged scale in order to reveal better the individual components. This device 1 comprises substantially two parts, namely a stiff sheet-like carrier 2 manufactured for example from cardboard and a dispenser 3 for the knife blades to be removed from it singly, the dispenser being mechanically connected to the carrier 2.

The carrier 2 has a hole near one end for hanging it up and below this it has a further opening 5 which is substantially rectangular and is interrupted in its central region by two transverse bars or webs 6 and 7. There are inwardly projecting tongues 8 in the corners at the outer ends of the substantially elongated rectangular opening 5.

The dispenser 3 comprises substantially the box-shaped housing 9 forming the upper part and a flat baseplate 10. Downwardly projecting hooks 12 are formed on the longer walls 11 of the box-shaped housing 9 and are able to engage in elongated openings 13 in the baseplate 10 in order to connect the housing 9 and the baseplate 10 mechanically and permanently together. The tongue-shaped hooks 12 form a kind of snap connection with the slots 13, this being possible by virtue of the components of the housing being made of plastics material having a limited degree of resilience.

The openings 13 are in a flange-like edge region 14 of the baseplate 10 so that the tongue-shaped hooks 12 which are inserted in the openings 13 do not project beyond the lower edge 15 of the baseplate 10.

The arrangement of the hooks 12 and openings 13 is such that a respective one of the transverse webs or bars 6,7 can pass between the adjacent hooks 12 and openings 13. In this way the dispenser 3 is mechanically connected to the carrier 2, in that the housing 9 is placed over the opening 5 from the front of the carrier 2 and the baseplate 10 is connected to the housing from the back of the carrier 2. The webs or bars 6 and 7 then extend through the assembled dispenser and also the tongues 8 engage between the housing 9 and the baseplate 10 in the region of the corners of the dispenser 3. In order to remove the dispenser 3 from the carrier 2 the carrier 2 must be destroyed, in that the webs 6 and 7 are torn away from the carrier 2. With this aim in mind the area 16 of the carrier 2 present alongside the laterally offset opening 5 provided in the carrier 2 can be torn inwards or indeed torn away altogether.

A stack of knife blades 17 is mounted in the dispenser 3 and urged against the cover plate 19 of the housing 9 by a leaf spring 18 supported on the baseplate 10 between the webs 6 and 7. At one end face of the housing there is a slot-shaped opening 21 between the top wall 19 and the face 20, through which the blades can be slid out individually. For this purpose the top wall 19 has a rectangular opening 22 which is initially closed by a cover 23. With the aid of a tongue 24 serving as a hand grip the cover 23 can be torn away from the housing so that then the top-most blade lies exposed in the region of the opening 22 and can be slid towards the removal opening 21 using a thumb, and can be removed from it. The cover 23 serves both as a protection against the environment and also as a protection against unauthorised removal of knife blades, for example when the device is still hanging on a sales stand and has not yet been regularly purchased.

The leaf spring 18 not only urges the stack of knife blades 17 against the top wall 19 of the housing 9 but also presses the baseplate 10 against the hooks 12 so that a slot-shaped space is present between the walls 11 and 20 of the housing 9 and the baseplate 10, providing a gap into which the webs 6 and 7 and the tongues 8 can enter.

Figure 3:
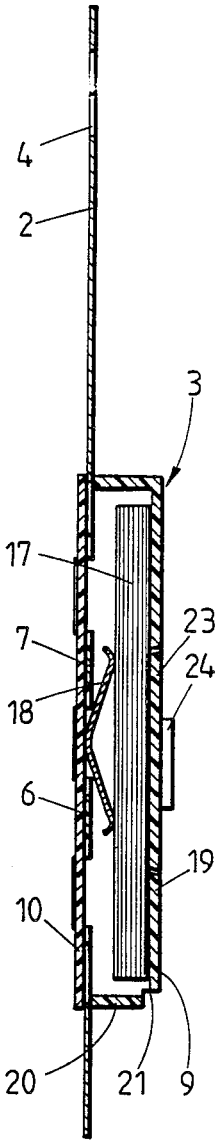
FIG. 3 is a section through this device on the line III—III in FIG. 2.
Figure 4:
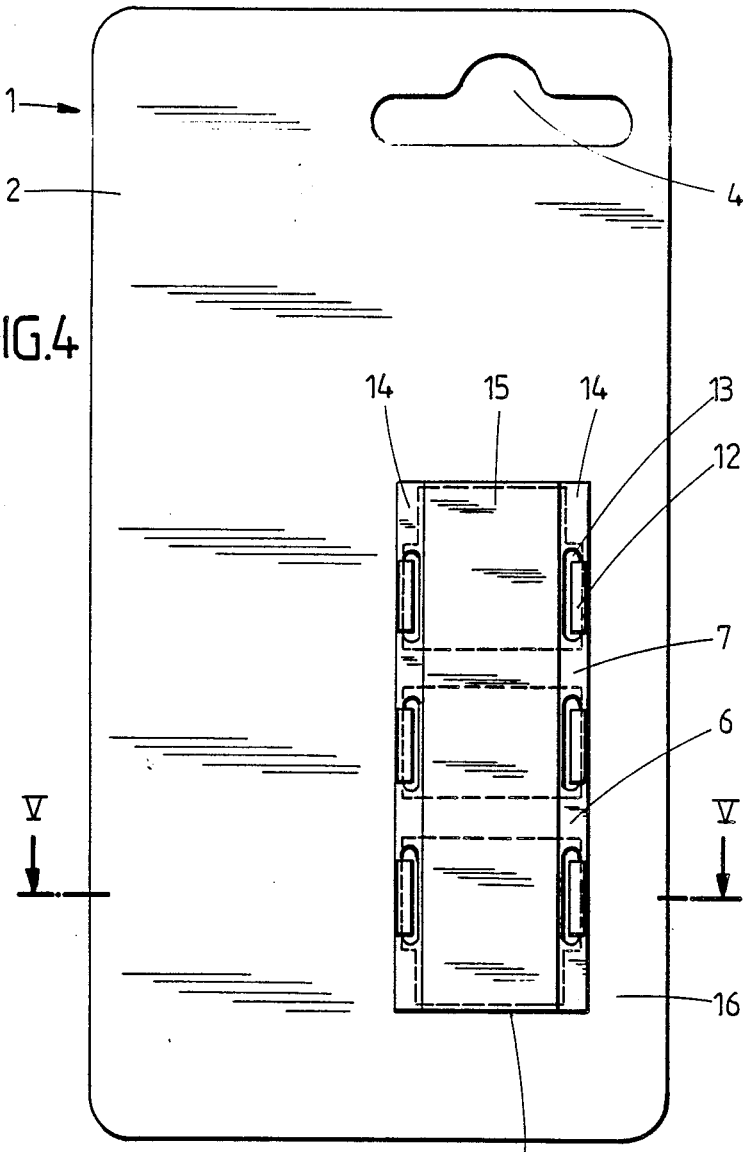
FIG. 4 is a view of the rear face of this device.
Figure 5:
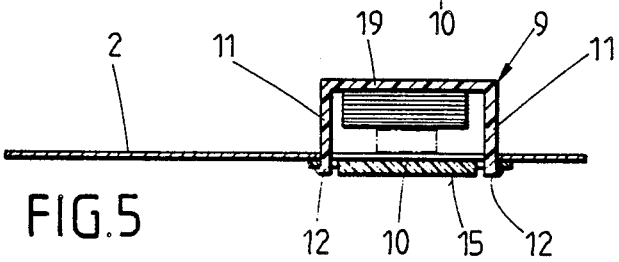
FIG. 5 is a cross-section through the device of FIGS. 1–4 taken on the line IV—IV in FIG. 4.
Figure 6:
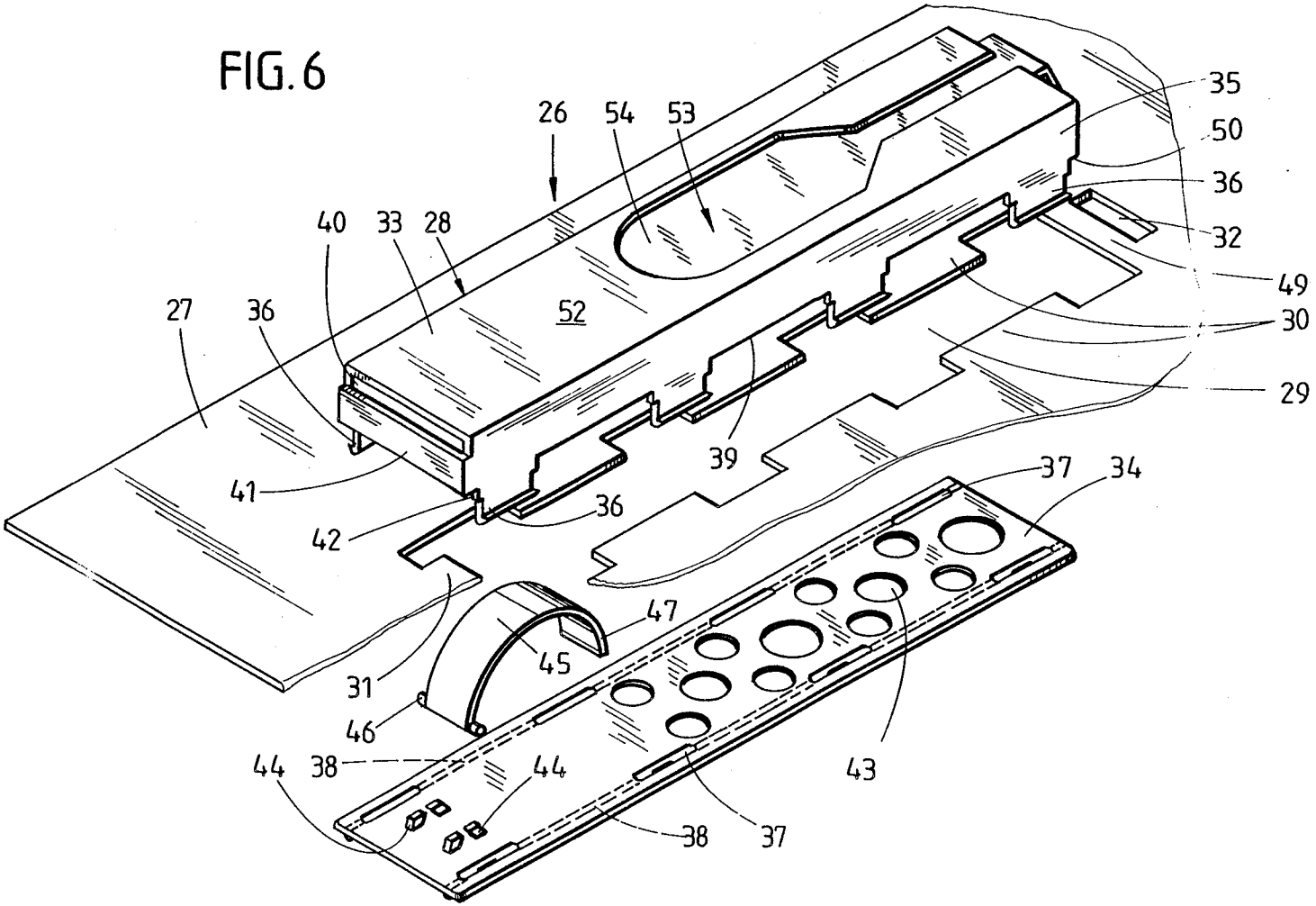
FIG. 6 is an exploded perspective view of a second embodiment of the holding means, some parts being shown broken away.
Figure 7:
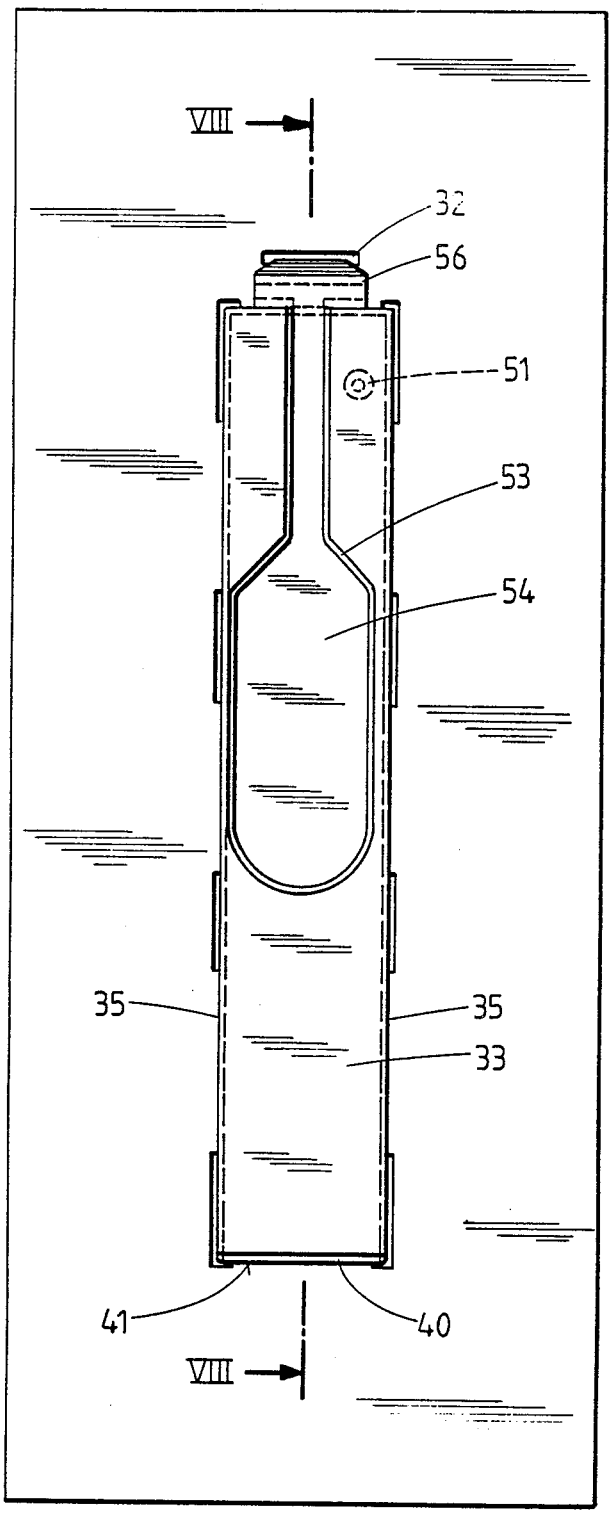
FIG. 7 is a plan view of the assembled device of FIG. 6.

Although the leaf spring 18 is shown in FIG. 3 in the region of the middle of the dispenser 3, in a preferred embodiment it is present near that end of the dispenser 3 which has the removal opening 21 so that it urges the packet or stack of blades 17 at one end in a direction towards the outlet. It could also be installed in a position which is the reverse of that shown in the drawing.

The second embodiment of the device, illustrated in FIGS. 6 to 10, is likewise shown to an enlarged scale in order to reveal better the individual components.

In this embodiment likewise the device 26 is again made up substantially of two parts, namely an sheet-like or card-like carrier 27, for example of cardboard, and a dispenser 28 for receiving knife blades for removal from it individually, the dispenser being mechanically connected to the carrier.

Approximately in its middle region the carrier 27 has a substantially rectangular opening 29 into which opposed rectangular tongues 30 project from the longitudinal edges. A further tongue 31 projects into the opening 29 at its bottom end. Immediately above or at a small distance from the other end of the opening 29 a further rectangular opening 2 is provided in the card-like carrier 27, the longitudinal extent of this further opening being at right angles to the longitudinal extent of the opening 29.

The dispenser 28 comprises substantially a box-shaped housing 33 forming the upper part of the dispenser and a flat baseplate 34. Downwardly projecting hooks 36 are formed on the longitudinal walls 35 of the box-shaped housing 33 and are capable of being inserted through elongated slots 37 in the baseplate 34 in order to connect the housing 33 and the baseplate 34 mechanically and permanently together. The tongue-shaped hooks form a snap connection with the slots 37 as both the housing 33 and also the baseplate 34 are made of plastics material having a certain degree of resilience.

Figure 8:
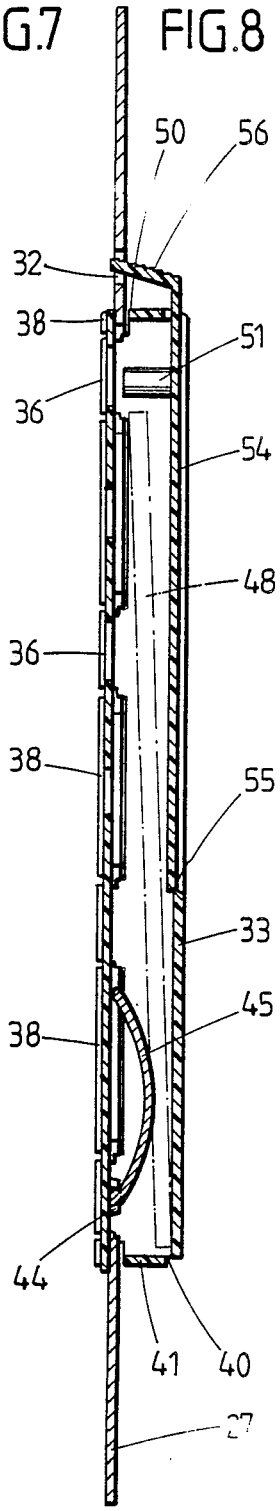
FIG. 8 is a longitudinal section through the device of FIGS. 6 and 7 on the line VIII—VIII in FIG. 7, FIG. 9. is a view of the rear face of this device
Figure 9:
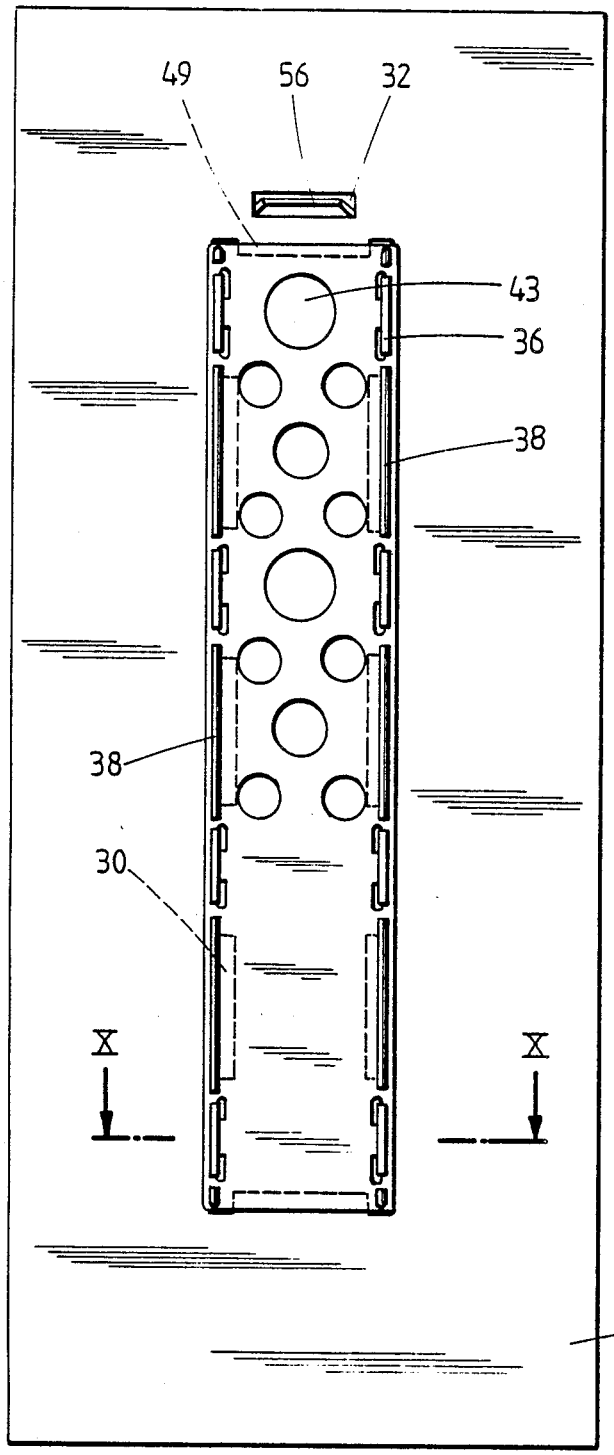
Figure 10:
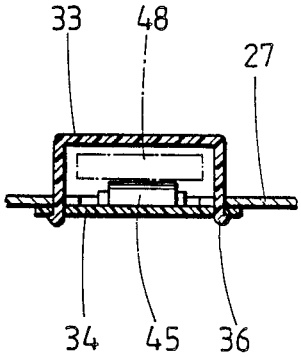
FIG. 10 is a cross-section of the device of FIGS. 6 to 9 on the line X—X in FIG. 9.

Rib-like beads 38 are provided on the underside of the baseplate 34 between the slots 37 in the baseplate, so that the tongue-like hooks 36 inserted through the slots 37 do not project individually beyond the lower face of the baseplate 34 but together with the beads form virtually continuous bars, as can best be seen in FIG. 8.

Rectangular cut-out portion 39 are provided in the side walls 35 of the housing 33 between adjacent or successive tongue shaped hooks 36 receiving the tongues 30 of the carrier 27 when the housing 33 is placed on the carrier 27 from above and the baseplate 34 is secured to the housing 28 from underneath. On the end face 41 of the housing 28 which extends downwards and is provided with a slot 40 for sliding out the individual knife blades there is a further rectangular cut-out 42 for the tongue 31.

The connection between the assembled dispenser 28 and the carrier 27 can only be freed by destroying the carrier 27, for example by tearing it apart.

The baseplate 34 is provided in it central region with several holes 43 to save weight and material.

On the upper face or inwardly facing wall of the baseplate 34 near that end which is below the slot 40 in the housing 33 in the assembled dispenser 28 there are upstanding inclined teeth 44, between which can be inserted from above with a snap engagement the pivot pins 46 which project laterally from a bowed elastic spring 45 made of plastics. The opposite end 47 of the spring 45 is freely movable on the baseplate 34.

A stack of blades 48 is mounted in the dispenser 28 and urged by the spring 45 to the level of the slot 40 for dispensing individual blades. The single blades are prevented from slipping out of a slot 50, provided at the opposite end of the housing 33 above the baseplate 34 for receiving a web 49 of 53 in the upper face of the housing 33, closed by a cover strip 54 and connected to the housing 33 through a kind of film hinge 55 so that it lies below the level of the surface of the housing 33. Overlying the housing 33 is a tongue-shaped strap 56 provided on this cover strip 54 and serving as a hand grip and initially projecting into the opening 32.

In order to be able to remove blades from the dispenser 28 it is necessary to free the cover strip 54 from the housing 32, which is possible without difficulty by tearing the film hinge 55 if one grasps the cover strip 54 by the strap 56 and pulls upwards. However this is only possible when the dispenser has been removed from the carrier 27 because the tongue 56 inserted in the opening 32 cannot be lifted from the undamaged carrier 27. Accordingly unauthorised opening of the dispenser while it is still on the carrier 27 is impossible.

However when the dispenser is opened the uppermost blade of the stack can be pressed with the thumb through the opening 53 and this blade can be slid out of the dispenser 28 through the slot 40.

The dispenser 3 or 28 or at least its housing 9 or 32 is preferably made of transparent plastics in order to be able to display its contents clearly visibly.

In the holding device for blades for sale, illustrated in the drawing, there is disclosed an extremely convenient sales aid in which the blades do not need to be secured to a carrier by means of a foil covering but are present in a dispenser from which they can be removed individually as required after sale of the device and after removal of a protective cover. The dispenser is mounted on the carrier, which is designed for hanging up, in such a way that it cannot be removed from it without destroying the carrier, yet is not held on the carrier by means of a covering film so that the blades to be sold are not only displayed in a particularly advantageous manner but the device serving as a sales aid can also be manufactured extremely economically.

The holding device is not only a pure sales pack but also holds the goods until their ultimate use. The device is extremely favourable to sales as it gives a clear view of the packaged goods. Moreover the device can be produced and packed with the goods at a very low cost. Finally the goods are also securely packaged, i.e. they cannot be removed in an unauthorised manner and there is also no danger of injury to the user.

We claim:

1. Means for holding goods intended for sale, said means comprising a carrier made of stiff card-like material, said carrier having an opening therein, and a dispenser comprising a housing and a baseplate, said dispenser containing spring means for urging goods stacked within said dispenser into a specific orientation against a top wall of said housing for dispensing of said gods through a slot in said housing, said dispenser being mounted in said opening in such a manner that at least a portion of said carrier interengages mechanically with said dispenser, and said spring means is in direct contact with said baseplate, and when said dispenser is released from said carrier, said carrier is destroyed without the necessity of opening said housing.

2. The means set forth in claim 1 wherein said carrier includes a hole by which it may be hung up.

3. The means set forth in claim 1 including at least one projection on said carrier projecting into said opening, and said housing including at least one recess, said at least one projection engaging in said at least one recess.

4. The means set forth in claim 3 wherein said opening is substantially rectangular and wherein said at least one projection comprises a tongue projecting inwards into said opening, and said at least one recess in the housing comprises an elongated slot.

5. The means set forth in claim 1 wherein said opening is substantially rectangular and further comprising at least one web extending across said opening, said housing including a slot therethrough and said web extending through said slot.

6. The means set forth in claim 1 including further a tear-off cover, said cover closing an opening in said top wall of said housing giving access to said goods.

7. Holding means for holding contents comprising sheet goods intended for sale and dispensing means for dispensing said sheet goods, said holding means comprising a carrier made of stiff card-like material and having an opening therein, a dispenser comprising a housing and a baseplate, mutually interengaging snap means on said housing and baseplate, said snap means when engaged securing said housing and baseplate together mechanically, said housing being assembled to said opening from one side of said carrier and said baseplate from the other side of said carrier whereby when said housing and baseplate are assembled together said carrier is trapped therebetween with at least a portion of said carrier engaging in said housing between said housing and baseplate and with said portion of said carrier sized so that said sheet goods contact said housing and one part of said dispensing means contacts said sheet goods and another part of said dispensing means contacts said baseplate.

8. The holding means set forth in claim 7 including a dispenser outlet opening in said housing and including a spring, said spring acting to urge said sheet goods into alignment with said outlet opening.

9. The holding means set forth in claim 8 wherein said spring is a bowed leaf spring having two ends, one of said ends being secured within said housing.

10. The holding means set forth in claim 7 wherein said housing has a manual access opening and further comprising a removable tear-off cover closing said access opening.

11. The holding means set forth in claim 7 including at least one projection on said carrier projecting into said opening, and said housing including at least one recess, said at least one projection engaging in said at least one recess.

12. The holding means set forth in claim 4 wherein said opening is substantially rectangular and further comprising at least one web extending across said opening, said housing including a slot therethrough and said at least one web extending through said slot.

13. The holding means set forth in claim 12 wherein said opening is substantially rectangular and wherein said at least one projection comprises a tongue projecting inwards into said opening, and said at least one recess in the housing comprises an elongated slot.

* * * * *